United States Patent [19]

Werth et al.

[11] Patent Number: 4,462,652

[45] Date of Patent: Jul. 31, 1984

[54] COUPLING NUT FOR AN ELECTRICAL CONNECTOR

[75] Inventors: Dee A. Werth, Afton; Alan L. Schildkraut, Sidney, both of N.Y.

[73] Assignee: The Bendix Corporation, Southfield, Mich.

[21] Appl. No.: 289,450

[22] Filed: Aug. 3, 1981

[51] Int. Cl.[3] ..... H01R 13/629

[52] U.S. Cl. ..... 339/89 M; 339/DIG. 2

[58] Field of Search ..... 339/DIG. 2, 89, 90; 285/81, 82, 89, 92; 411/328

[56] References Cited

U.S. PATENT DOCUMENTS

| | | | |
|---|---|---|---|
| 962,321 | 6/1910 | Crouch | 411/328 |
| 1,421,090 | 6/1922 | Larson | 411/328 |
| 2,422,982 | 6/1947 | Quackenbush | 174/87 |
| 2,728,895 | 12/1955 | Quackenbush et al. | 339/89 |
| 2,784,385 | 3/1957 | Ennis | 339/89 |
| 2,890,434 | 6/1959 | Ray et al. | 339/91 |
| 3,343,852 | 9/1967 | Blight et al. | 339/DIG. 2 |
| 3,351,886 | 11/1967 | Zimmerman, Jr. | 339/90 |
| 3,517,371 | 6/1970 | Buckley | 339/89 |
| 3,587,032 | 6/1971 | Normann | 339/89 M |
| 3,594,700 | 7/1971 | Nava et al. | 339/89 R |
| 3,601,764 | 8/1971 | Cameron | 151/2 R |
| 3,732,527 | 5/1973 | McKnight | 339/103 M |
| 3,786,396 | 1/1974 | Kemmer et al. | 339/89 R |
| 3,808,580 | 4/1974 | Johnson | 339/89 R |
| 3,869,186 | 3/1975 | Vetter | 339/89 R |
| 3,971,614 | 7/1976 | Paoli et al. | 339/89 R |
| 4,030,798 | 6/1977 | Paoli | 339/89 R |
| 4,056,298 | 11/1977 | Cooper et al. | 339/90 R |
| 4,109,990 | 8/1978 | Waldron et al. | 339/89 M |
| 4,152,039 | 5/1979 | Shah | 339/89 M |
| 4,183,605 | 1/1980 | Arneson | 339/89 M |
| 4,239,314 | 12/1980 | Anderson et al. | 339/89 M |
| 4,257,663 | 3/1981 | Brush et al. | 339/89 M |
| 4,268,103 | 5/1981 | Schildkraut et al. | 339/89 M |
| 4,272,144 | 6/1981 | Brush et al. | 339/89 R |
| 4,291,933 | 9/1981 | Kakaris | 339/DIG. 2 |

FOREIGN PATENT DOCUMENTS

| | | | |
|---|---|---|---|
| 147887 | 9/1931 | Switzerland | 411/328 |
| 1454099 | 10/1976 | United Kingdom . | |
| 1510861 | 5/1978 | United Kingdom . | |

*Primary Examiner*—John McQuade

*Attorney, Agent, or Firm*—Charles D. Lacina

[57] ABSTRACT

A coupling ring (30) including a coupling nut (40) circumposed around a plurality of serrations (18) and an unlocking sleeve (50) rotatably mounted to the coupling nut. An arcuately shaped lock member (60) carried by the coupling nut, in cooperation with a spring (66), allows rotation of the nut in a coupling direction and prevents rotation in an uncoupling direction, the lock member being pinned at one end (60*a*) to the coupling nut and free at the other end (60*b*) to pivot, the other end being provided with teeth (68) to releasably engage with succeeding of the serrations. The uncoupling sleeve (50) carries a lifter (54) having a free end (54*b*), the free end normally biased by a compression spring (52) into spaced-apart relation to lock member (60) and adapted to drive nut (40) in the coupling direction. Sleeve (50) with lifter (54) is mounted to rotate in the uncoupling direction independently of coupling nut (40), uncoupling rotation of uncoupling sleeve (50) forcing free end (54*b*) of lifter (54) against lock member (60) to deflect the pivotable end (606) upwardly and thereby disengage teeth (68) thereof from engagement with serrations (18).

20 Claims, 4 Drawing Figures

FIG. 1
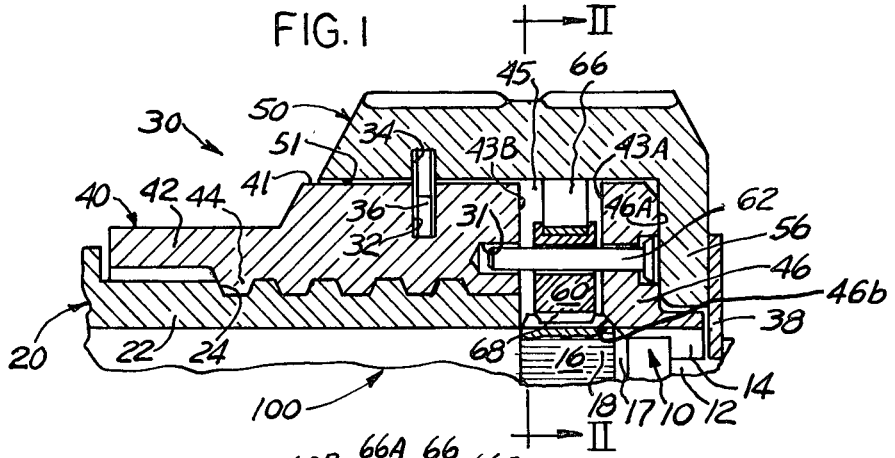
FIG. 2
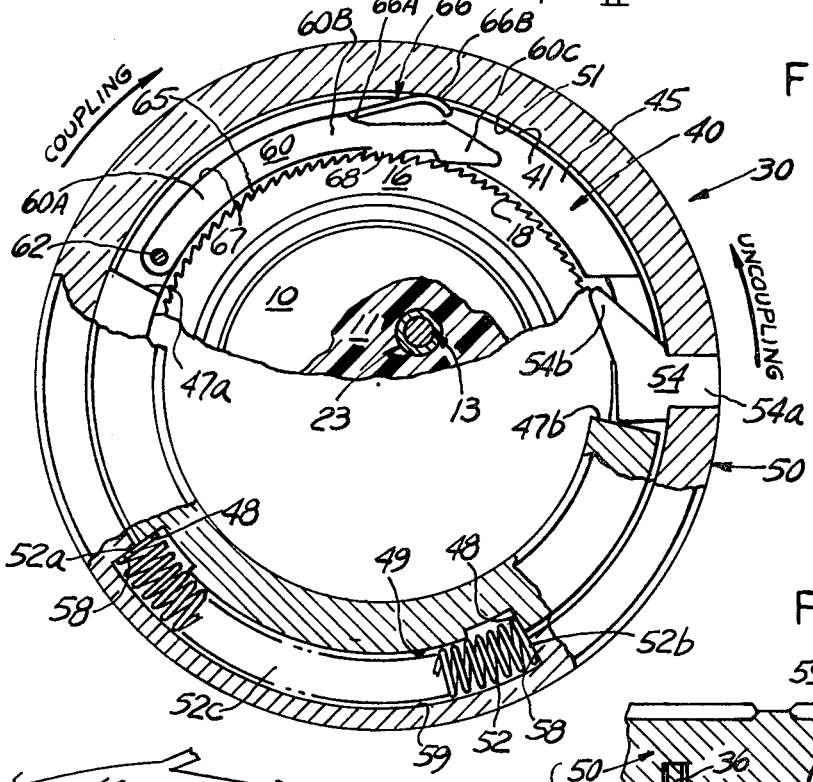
FIG. 3
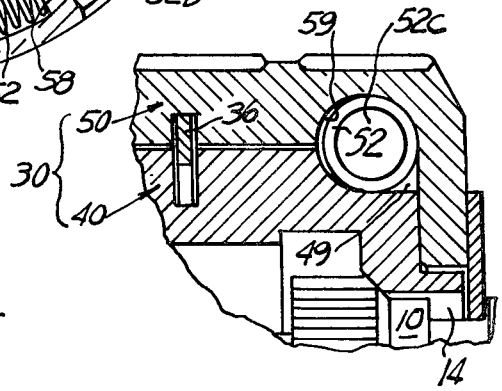
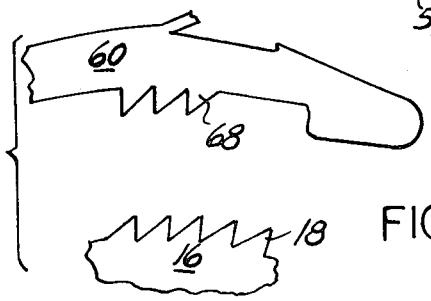
FIG. 4

COUPLING NUT FOR AN ELECTRICAL CONNECTOR

This invention relates to a coupling nut for an electrical connector and particularly to a coupling ring providing improved anti-decoupling in an electrical connector assembly.

Electrical connector assemblies are generally comprised of two separate electrical connectors, each having contacts matable with contacts of the other when the electrical connectors are connected together by a coupling member. The coupling member is generally mounted to one of the electrical connectors by one or more snap rings to rotatably captivate a flange of the coupling member adjacent to a shoulder of the one connector.

During mating and unmating, electrical connectors should be easily and quickly coupled and decoupled with the use of reasonable forces. Once mated and in use, however, the electrical connector assembly must remain connected despite vibrational and/or other forces which might be applied to the connector assembly and which might uncouple the connectors. Accordingly, various anti-rotation devices to prevent unwanted back-off and/or disconnection are known.

Many anti-rotation designs chordally interpose a tooth member between the coupling nut and a toothed portion of the connector shell to which the nut is mounted. U.S. Pat. No. 4,109,990 issuing Aug. 29, 1978 to Waldron et al. supported ends of an elongated beam 321 on the inner wall of coupling nut 300 so as to be medially tangent to a shoulder 140 of the shell provided with teeth 141, thereby positioning a medial tooth 323 of the beam to engage the teeth. Since the elongated beam acts like a spring and the mid-point will yield, a straight beam may not provide the best engagement between teeth at the point of tangency. To improve this, the teeth were provided with inclinations. The tooth, while resisting uncoupling rotation, desirably would be more secure and lock against unwanted rotation. U.S. Pat. No. 4,272,144 issuing June 9, 1981 to Brush et al. provided on the inner wall of a coupling nut 20 a chordally extending axle 40, the axle including a tooth 48 intermediate to a pair of centering springs 50, the tooth engaging serrations on the connector, one spring compressing to resist rotation in one direction and the other spring compressing to resist rotation in the other direction. A similar construction is shown in U.S. Pat. No. 4,257,663 issuing Mar. 27, 1981 to Brush et al. While suitable, such constructions constantly and consistently resist rotation tending to uncouple a connection but do not provide a positive lock against unwanted decoupling rotations.

Further, metal-to-metal contact with large spring forces tends to wear against the material. To avoid this, U.S. Pat. No. 4,268,103 issuing May 19, 1981 to Schildkraut et al. provided the inward face of the chordal spring 321 with a suitable wear resistant plastic.

Ratchets and pawls are known to allow movement in one direction but to prevent movement in the other direction. An electrical connector, as noted must be capable of being uncoupled. It would be desirable to combine the sureness of anti-rotation of the ratchet with the flexible uncoupling capability of a compressible spring.

In most applications, controlled means for decoupling of a locked assembly upon attainment of a certain force would be desirable. Means for uncoupling the connectors, which acts independently of the anti-decoupling arrangement and controlled by the user, would be desireable. A lock device provided in U.S. Pat. No. 3,601,764 issuing Aug. 24, 1981 included means for uncoupling a connector but the lock did not provide a lock which would tighten under vibration. Similarly, see U.S. Pat. No. 3,869,186 issuing Mar. 4, 1975 to Vetter.

SUMMARY OF THE INVENTION

The invention is a coupling arrangement for resisting uncoupling of a electrical connector assembly and includes a coupling ring mounted to an electrical connector. The coupling ring releasably couples together first and second generally cylindrical electrical connector shells movable into mating relation by axial mating movement between the shells, the coupling ring being sized to be received over and captivated for rotation within an annular groove in one of the shells, the one connector shell having a radial flange therearound provided with a plurality of serrations.

The coupling ring comprises a coupling nut and an uncoupling sleeve, the sleeve being concentrically mounted for rotation about the nut. The coupling nut threadably draws the one shell towards the other shell and includes a rigid lock member having one end pinned to the coupling nut and the other end free to pivot thereabout. The other end includes a tooth portion facing the serrated flange and an outwardly extending spring member, the tooth portion being adapted to releasably engage with the serrations and the spring member having its free end acting against an inner wall of the uncoupling sleeve to bias the tooth into engagement with successive serrations to prevent relative uncoupling motion. A lifter extends inwardly from the inner wall of the sleeve to a free end, the free end being normally biased by a compression spring into angularly spaced relation from the lock member. The free end of the lifter is adapted to drive the nut to rotate in the coupling direction and to rotate independently of the coupling nut in the uncoupling direction, rotation of the uncoupling sleeve in the uncoupling direction causing the lifter end to engage the lock member and lift the tooth portion thereof from engagement with the serrations. The compression spring, received in an annular spring cavity formed between respective spring seats on the coupling nut and uncoupling sleeve, resists relative rotation therebetween to urge the lifter into its position angularly spaced from the lock member. When the user forces the uncoupling sleeve in the coupling direction, the uncoupling sleeve constrains the nut to rotate and the two rotate as a unit to couple the shells. When the uncoupling sleeve is forced in the uncoupling direction, the compression spring is compressed and the lifter rotated around to engage the lock member to disengage the tooth, whereupon the connector assembly released from the mated connection.

ADVANTAGES OF THE PRESENT INVENTION

One advantage of the subject invention is the provision of a coupling arrangement providing a continuous succession of locked positions to a connector plug/-receptacle assembly.

A further advantage is a coupling ring providing improved resistance against forces of vibration.

Another advantage of the subject invention is a coupling nut which may be locked against vibration but unlocked by a user to decouple an electrical connector assembly.

Still another advantage is that a partially mated connector assembly would tend to tighten under vibration due to one way ratchet teeth.

Yet another advantage of the invention is that there is less wear on the anti-rotation arrangement (i.e. ratchets) due to the absence of high frictional spring forces.

DETAILED DESCRIPTION OF THE INVENTION

FIG. 1 is a side view, in section, of an electrical connector having a coupling ring.

FIG. 2 is a front view, in section, taken along lines II—II of FIG. 1 of the electrical connector in the coupled position.

FIG. 3 is a side view, in section, at a different angular position of the electrical connector of FIG. 1.

FIG. 4 shows detail of teeth and serrations which permit the uni-direction ratation of the coupling ring. FIG. 1 shows an electrical connector assembly 100 incorporating a coupling ring 30 according to the principles of this invention. The assembly comprises a receptacle (connector member) 20 and a plug (connector member) 10, each connector carrying within their respective cylindrical shells 12, 22 a dielectric member (not shown) which supports a mateable electrical contact 13, 23 (See FIG. 2) which is, in turn, terminated to an electrical wire (not shown). Receptacle shell 22 includes an externally threaded forward portion 24. Plug shell 12 includes a forward portion that interfits within the forward portion of the receptacle shell, an outwardly extending radial flange 16 having a tapered rearward face 17 and an annular groove 14 sized to receive a radial flange 46 of the coupling ring and a retaining ring 38. Coupling ring 30 is mounted for rotation to the plug shell between radial flange 16 and annular groove 14 and captivated therebetween by retaining ring 38. The outer circumferential face of radial flange 16 is provided with a plurality of grooves or serrations 18 to facilitate obtaining a locking engagement with a lock member 60.

Coupling ring 30 comprises a cylindrical coupling nut 40 and a cylindrical uncoupling sleeve 50 concentrically disposed and mounted for rotation thereabout. In the embodiment shown, uncoupling sleeve 50 is carried by coupling nut 40.

The coupling nut 40 includes a shell 42 having an outer surface 41 and internally threaded portion 44 adapted to be screwed onto the externally threaded forward portion 24 of receptacle shell 22, the outer surface 41 including a second annular groove 32 sized to receive a second retaining ring 36. The inwardly extending radial flange 46 includes an outer face **46*a* disposed adjacent to retaining ring 38 and a tapered inner face 46*b* disposed adjacent to radial flange 16 of plug shell 12, the tapered inner face 46*b* being configured to seat about the tapered rearward face 17 of flange 16 so as to aid centering and rotation of the coupling nut. An annular lock cavity 45 extends through shell 42 and is defined by a pair of separated axial faces 43*a*, 43*b* and by a pair of end faces 47*a*, 47*b* (see FIG. 2). A bore 31 of sufficient size to receive a mounting pin 62 extends axially through the coupling nut and through the lock cavity 45**.

A pawl-like lock member 60 of rigid material is disposed in the annular lock cavity 45 of the nut, lock member 60 having a first end portion **60*a* secured to the coupling nut by the mounting pin 62 and a second end portion 60*b* free to pivot relative to its securement. The lock member is arcuately shaped and includes inner and outer radial surfaces 65, 67 (see FIG. 2**).

A plurality of teeth 68 are disposed on the inner surface 65 and at the end of the lock member, the teeth 68 being configured to periodically and releasably engage successive of the serrations 18 and permit relative rotation between the plug shell and the coupling nut only in the coupling direction. A spring member 66 extends between the outer surface 67 of lock member 60 and uncoupling sleeve 50 to bias the lock member into engagement with successive of the serrations 18. Preferably and in accord with this invention, spring member 66 is a cantilever beam having one end **66*a* secured to lock member 60 and its other end 66*b* free to act against the uncoupling sleeve, the beam being substantially flat so as to provide a broad contact path. A thin finger-like member, as well as other springs, could be utilized without departing from the invention. Lock member 60 should be rigid and could be molded of a high performance polymer (e.g. such as "Torlon") with the spring member 66** being an integrally molded part.

Uncoupling sleeve 50 is rotatably mounted to coupling nut 40 and includes a radial inner wall 51 concentrically circumposed around the serrations. Inner wall 51 includes an annular groove 34 adapted to register with groove 32 of the nut and sized to receive the retaining ring 36 to thereby position the sleeve about the nut. A radial flange 56 is adapted to cover bore 31 to retain the pin and be captivated between coupling nut flange 46 and retaining ring 38.

FIG. 2 shows, partially in cut out, electrical contacts 13, 23 in their mated condition. As shown, contact 13 in plug 10 is a pin-type contact and contact 23 in receptacle 20 is a socket-type contact. Other contacts, of course, could be used.

In FIG. 2, a lifter 54 extends radially inward from inner wall 51, lifter 54 having one end **54*a* secured to the sleeve and a free end 54*b* adapted to engage the deflectable end 60*c* of lock member 60 upon rotation of the uncoupling sleeve 50 from a first position in an uncoupling direction. The free end 54*b* is adapted to constrain (i.e. drive) the coupling nut to rotate in the coupling direction during coupling and operative to rotate independently of the coupling nut in the uncoupling direction, the free end 54*b* abutting end face 47*b*** to drive the nut.

An annular spring cavity **52*c* is formed between an annular spring recess 49 in the coupling nut and an annular spring recess 59 in the uncoupling sleeve, the spring recesses being coextensive and adapted to be in register when in a coupled position and to be angularly shifted when the nut and sleeve are rotated, spring recess 49 including a pair of spring seats 48 and spring recess 59 including a pair of spring seats 58. A helical compression spring 52 is sized to fit within spring cavity 52*c* and have its ends 52*a*, 52*b* urge against the respective spring seats. The compression spring normally biases lifter 54 away from lock member 60. Further, compression spring 52 is designed with sufficient compression force as not to allow sleeve 50 to inadvertently rotate or chatter during severe vibration to potentially cause lifter 54 to contact lock member 60**.

FIG. 3 shows compression spring 52 received in annular spring cavity **52*c* formed between the opposite spring recesses 49, 59**.

FIG. 4 illustrates lock member 60 and radial flange 16 of the plug 10 slightly separated to show, respectively, detail of teeth 68 and serrations 18. The teeth 68 have a straight (substantially radial) portion and an inclined portion which are sized to interfit (i.e. mesh) with like straight/inclined portions on each serration 18. The shape of the teeth/serrations are configured to permit uni-direction rotation which are not friction dependent as the aforesaid chordal springs as typified by U.S. Pat. No. 4,109,990 to Waldron et al. Further, as noted above, lock member 60 could be integrally molded of "Torlon" into a one piece member.

OPERATION

The lock member 60 would be fit into lock cavity 45 and secured to the nut 40 by pin 62. Uncoupling sleeve 50 would then be positioned onto the nut 40 by retaining ring 36 to form the coupling ring 30.

The coupling ring 30 would be positioned on the plug shell 12 and captivated thereto by retaining ring 38. Plug shell 12 is then inserted into receptacle shell 22 and the coupling ring 30 rotated in a first coupling direction. The uncoupling sleeve 50 would rotate as a rigid body with coupling ring 30 due to the end of lifter 54 abutting against end face 47*b* of the coupling nut 40, the rotation drawing the shells together and the contacts mated. For small vibrational forces and nomal handling, compression spring 52 would be sufficient to prevent the uncoupling sleeve lifter to rotate and/or to engage the lock member. For larger forces, such as provided by a user, uncoupling sleeve 50 could be forced to rotate in the uncoupling direction and present the lifter 54 to the lock member 60.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

We claim:

1. A coupling nut for use with a cylindrical shell (12) having serrations (18) disposed therearound, said coupling nut being adapted to be rotatably mounted to the shell and characterized by:

a lock member (60) of rigid material having a first end portion (60*a*) secured to the coupling nut by a pin (62) and a second end portion (60*b*) free to pivot about the pin, the second end portion including a tooth (68) configured to releasably engage successive of the serrations (18) and allow rotation if the coupling nut is rotated in the coupling direction and to non-releasably engage successive of the serrations and prevent rotation if the coupling nut is urged in an uncoupling direction;

a spring member (66) adapted to normally bias tooth (68) into locked engagement with the successive serrations (18); and means (50, 54) for releasing the lock member from its locked engagement with the serrations, said releasing means being normally disposed in spaced relation to said lock member and adapted to be rotated against the lock member for releasing.

2. A coupling nut as required in claim 1 wherein the releasing means (50, 54) comprises:

an uncoupling sleeve (50) rotatably mounted to the coupling nut and having a radial inner wall (51) circumposed around the serrations;

a lifter (54) carried by uncoupling sleeve (50) and having a free end (54*b*) extending towards first shell (12), said free end (54*b*) being adapted to cam against lock member (60) and deflect tooth (68) from engagement with the serrations; and means (52) for resisting uncoupling rotation of lifter (54) towards lock member (60).

3. A coupling nut as required in claim 2 wherein said resisting means (52) comprises:

a first spring seat (58) on said uncoupling sleeve;

a second spring seat (48) on said coupling nut; and a compression spring (52) having its opposite ends (52*a*, 52*b*) disposed to abut against respective of said spring seats.

4. A coupling nut as required in claim 2 wherein said spring member (66) is secured to said lock member (60) and includes a free end (66*b*) which engages uncoupling sleeve (50).

5. A coupling nut as required in claim 4 wherein lock member (60) is arcuately shaped and includes an outer radial surface (67) disposed in faced relation with radial inner wall (51) and spring member (66) is an elongated cantilever beam secured at one end to lock member (60), the beam having its other end (66*a*) extending from its securement to the lock member and free to act against radial inner wall (51) of uncoupling sleeve (50).

6. An electrical connector coupling ring for use in connecting together a pair of connector shells, said coupling ring characterized by:

a coupling nut (40) adapted to be rotatably mounted to one connector shell and be coupled to the other connector shell, rotation of the coupling nut in one or another direction coupling or uncoupling the shells to draw and hold the shells together;

preventing means (60, 62) carried by said coupling nut for preventing relative uncoupling rotation between said coupling nut and said one shell; and permitting means (50, 54) operating only upon application of an external force for permitting uncoupling rotation of said coupling nut, said permitting means being normally spaced from said preventing means and operating independently of said coupling nut rotation and only upon being forced against said preventing means to release the preventing means.

7. An electrical connector coupling ring as required in claim 6 wherein;

said one shell includes a plurality of serrations (18) disposed annularly thereabout;

said preventing means (60, 62) comprises a lock member (60) and a pin (62), said lock member being comprised of a rigid material and having first and second end portions (60*a*, 60*b*) with said first end portion (60*a*) being secured to coupling nut (40) by pin (62) and said second end portion (60*b*) being free to pivot relative to the pin, the second end portion (60*b*) including a tooth (68) circumposed above the serrations (18) and configured to allow single direction rotation of said coupling nut and releasably engage/disengage with successive of said serrations as the coupling nut (40) is rotated in the coupling direction; and said permitting means (50, 54) comprises an uncoupling sleeve (50) disposed for rotation about said coupling nut (40) for receiving said external force and a lifter (54) carried by said uncoupling sleeve and spaced from said lock member (60), rotation of said uncoupling sleeve (50) driving the lifter (54) against the coupling nut (40) or the lock member (60) depending, respectively, upon whether the uncoupling sleeve (50) is rotated in the coupling or uncoupling directions, whereby as said uncoupling sleeve (50) is rotated in the coupling direction the tooth (68) is cammed upwardly and released from engagement with its serration (18) and coupling nut (40) and uncoupling sleeve (50) rotate together as a unit and when said uncoupling sleeve (50) is rotated in the uncoupling direction said lifter (54) rotates to and engages said lock member (60) and deflects the lock member upwardly and the tooth from engagement with its serration (18) and the coupling nut (40) rotates in the uncoupling direction with the uncoupling sleeve.

8. An electrical connector coupling ring as required in claim 7 wherein said uncoupling preventing means (60) further includes a compression spring (52) adapted to resist uncoupling rotation of uncoupling sleeve (50) and a spring member (66) adapted to constantly bias tooth (68) into the serration, said spring member (66) extending from the second end portion of lock member (60) to a free end (66*b*) engaging the unlocking sleeve.

9. An electrical connector comprising: first and second generally cylindrical shells (22, 12) with the second shell (12) having a plurality of serrations (18) disposed annularly therearound and a coupling nut (40) rotatably mounted to the second shell and adapted to connect with the first shell to couple the shells together when rotated in a coupling direction, characterized by:

a rigid lock member (60) carried by the coupling nut for permitting only coupling rotation, said lock member having first and second end portions (60*a*, 60*b*) with the first end portion (60*a*) thereof being rotatably pinned to the coupling nut and said second end portion (60*b*) being adapted to pivot relative to first end portion (60*a*), the second end portion including a tooth (68) configured to releasably mesh with successive serrations (18) and prevent uncoupling rotation of the coupling nut relative to the one shell;

a spring member (66) normally biasing said second end portion (60*b*) of lock member (60) into meshed engagement against each of the successive serrations; and means (50, 54) for deflecting lock member (60) and its tooth (68) from meshed engagement with the successive serrations, said deflecting means being spaced from the lock member and constrained to rotate independently of the coupling nut, such deflection releasing tooth (68) from engagement to allow rotation of coupling nut (40) in the uncoupling direction.

10. An electrical connector as required in claim 9 wherein said deflecting means (50, 54) includes an uncoupling sleeve (50) constrained to rotate nut (40) in the coupling direction and adapted to rotate independently of nut (40) in uncoupling direction, said uncoupling sleeve having an inner wall (51) superposing the successive serrations during rotation.

11. An electrical connector as required in claim 10 wherein coupling nut (40) includes an end face (47*b*) and uncoupling sleeve (50) includes a lifter (54) having a free end (54*b*) extending inwardly from inner wall (51) and adapted to abut said end face (47*b*) when the coupling nut is rotated in the coupling direction, said free end (54*b*) being disposed in spaced relation to lock member (60) and configured to cam second end portion (60*b*) of lock member (60) upwardly when the uncoupling sleeve is rotated in the uncoupling direction, whereupon tooth (68) is released from engagement with serrations (18).

12. An electrical connector as required in claim 11 wherein unlocking sleeve (50) includes a first spring seat (58), coupling nut (40) includes a second spring seat (48), and a compression spring (52) is disposed between unlocking sleeve (50) and coupling nut (40) such that opposite ends (52*a*, 52*b*) of compression spring (52) act against respective of spring seats (48, 58) to resist uncoupling direction rotation of unlocking sleeve (50) relative to coupling nut (40).

13. An electrical connector assembly (100) of the type including a pair of shells (10, 20), a coupling nut (40) rotatably mounted on one of said shells and arranged to be threaded on the other of said shells to hold said shells together and means for resisting relative uncoupling rotation between said coupling nut and said one of said shells, said one of said shells being provided with a plurality of serrations (18), said resisting means characterized by:

a rigid lock member (60) pivotally carried by coupling nut (30) and having a tooth (68) arranged to be pivoted radially into engagement with successive of said serrations (18) as coupling nut (40) is rotated in a coupling direction;

means (66) extending from the lock member for normally biasing tooth (68) into engagement with said serrations; and a lifter (54) having a free end (54*b*) to constrain coupling nut (40) to rotate in the coupling direction during coupling and operative to rotate independently of the coupling nut in the uncoupling direction, said lifter being normally spaced from lock member (60) and adapted to deflect tooth (68) from engagement with its serration when rotated thereagainst.

14. An electrical connector assembly as required in claim 13 wherein lock member (60) comprises a series of teeth (68) so spaced as to engage, respectively, successive ones of the serrations.

15. An electrical connector assembly as required in claim 13 further comprising:

an uncoupling sleeve (50) rotatably carried by coupling nut (40) and having an inner wall (51) facing serrations (18), said lifter (54) being mounted to the inner wall; and means (52) for resisting uncoupling rotation of lifter (54) towards lock member (60).

16. An electrical connector assembly as required in claim 15 wherein lock member (60) is generally acruate and includes inner and outer radial surfaces (65, 67) and a tapered deflectable end (60*c*), outer radial surface (67) being disposed in faced relation with inner wall (51) and inner radial surface (65) disposed in faced relation to serrations (18), such that upon rotation of uncoupling sleeve (50) in the uncoupling direction, lifter (54) advances toward and engages lock member (60), thereby deflecting the free end (54*b*) of lock member (60) upwardly and disengaging tooth (68) from locked engagement with the serrations.

17. An electrical connector assembly as required in claim 16 wherein said biasing means (66) is an elongated spring member having one end (66*a*) secured to lock member (60) and having its other end (66*b*) extending therefrom and urging against inner wall (51) of unlocking sleeve (50).

18. An electrical connector assembly as required in claim 17 wherein said spring member (66) is a resilient cantilever beam.

19. An electrical connector assembly as required in claim 18 wherein said spring member (66) is substantially flat.

20. An electrical connector assembly as required in claim 15 wherein:

said means (52) for resisting uncoupling rotation of lifter (54) includes a compression spring (52) disposed to have one of its ends (52*a*) act against a first spring seat (58) on uncoupling sleeve (50) and the other of its ends (52*b*) against a second spring seat (48) on coupling nut (40), the compression spring operative to resist movement of uncoupling sleeve (50) relative to coupling nut (40) and to bias lifter (54) in angularly spaced relation to lock member (60).

* * * * *